US005647678A

United States Patent [19]

Trombley

[11] Patent Number: 5,647,678

[45] Date of Patent: Jul. 15, 1997

[54] CARTRIDGE FOR COOLING A THERMAL PRINT HEAD

[75] Inventor: Donald C. Trombley, Rochester, N.Y.

[73] Assignee: Eastman Kodak Company, Rochester, N.Y.

[21] Appl. No.: 604,282

[22] Filed: Feb. 21, 1996

[51] Int. Cl.[6] ..... B41J 35/28

[52] U.S. Cl. ..... 400/208; 400/207; 347/223

[58] Field of Search ..... 400/208, 53, 54, 400/207, 208.1; 347/223

[56] References Cited

U.S. PATENT DOCUMENTS

| | | | |
|---|---|---|---|
| Re. 33,260 | 7/1990 | Stephenson | 346/76 |
| 4,973,983 | 11/1990 | Yamamoto et al. | 347/223 |
| 5,176,458 | 1/1993 | Wirth | 400/120 |
| 5,374,944 | 12/1994 | Janosky et al. | 347/223 |
| 5,519,429 | 5/1996 | Zwijsen et al. | 347/223 |

*Primary Examiner*—John S. Hilten
*Attorney, Agent, or Firm*—Nelson A. Blish

[57] ABSTRACT

A dye donor cartridge (17) for a thermal printer (10) is disclosed. Uniformity of the image intensity in the thermal print head (12) is achieved by carefully controlling an ambient temperature of the print head. This control of ambient temperature is achieved with an air flow arrangement, wherein air is supplied to the dye donor cartridge (17), and through cartridge vents (54) to print head heatsink (15). In one embodiment of the invention, cartridge vents (54) vary in size to provide extra cooling to portions of the printhead assembly (12) to maintain a substantially uniform temperature along its length.

9 Claims, 6 Drawing Sheets

10
16
17
22
20
18
28
24
15
13
26
30
12
14

FIG. 6
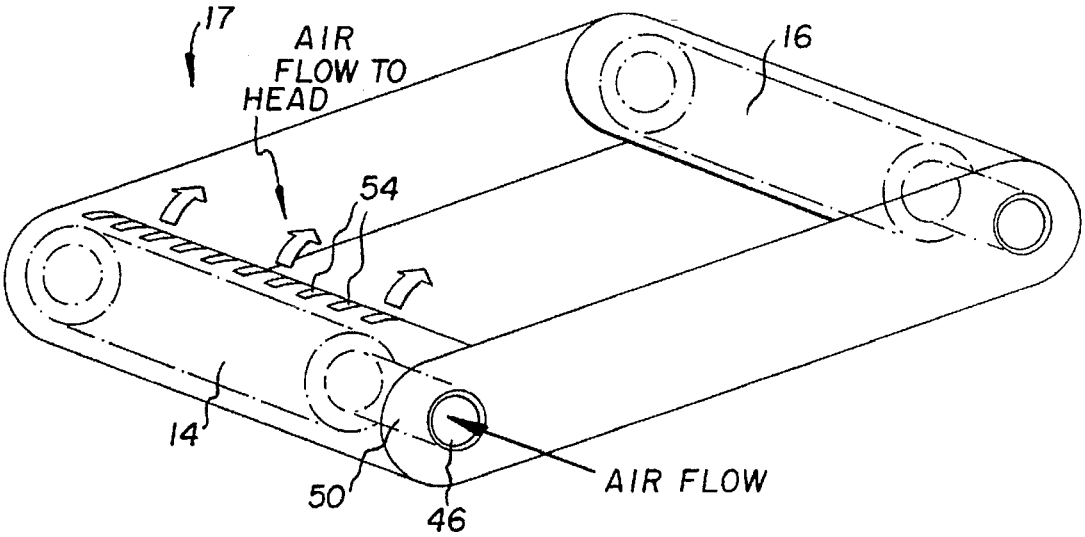
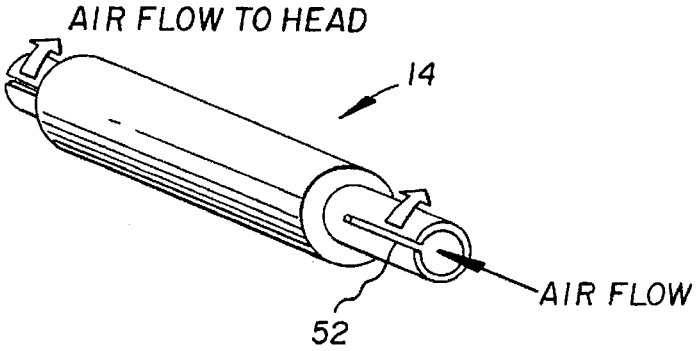
FIG. 7

CARTRIDGE FOR COOLING A THERMAL PRINT HEAD

TECHNICAL FIELD

This invention relates generally to thermal printers and in particular, to a cartridge containing a dye donor web and adapted for cooling the print head on thermal printers.

BACKGROUND ART

The present invention is particularly useful in a printer apparatus wherein a web of dye donor is advanced from a supply roll, past a thermal print head, to a motorized take-up roll. Referring to FIG. 1, a thermal printer 10 includes a print head assembly 12; dye donor web supply roll 14 and take-up roll 16, contained in a cartridge 17; a roller platen assembly 18; a pair of pinch rollers 20 and 22; a dye receiver medium transport guide 30; and a dye receiver medium supply 24.

Normal thermal printer operation includes loading dye receiver medium, printing information upon the dye receiver medium, and ejecting the finished print. Each of these operations is fully described in commonly-assigned U.S. Pat. No. 5,176,458, which issued on Jan. 5, 1993. Therefore only a brief description will be given of the illustrated embodiment of the thermal printer.

Printer operation begins with a loading phase, in which a sheet 28 of dye receiver medium advances from supply 24 along guide 30 to a gap between print head assembly 12 and platen assembly 18. The leading edge of sheet 28 is held in the nip of rollers 20 and 22. Print head assembly 12 moves toward roller platen assembly 18, pressing dye donor web 26 and the dye receiver medium 28 against roller platen assembly 18, to form a sandwich for thermal printing.

Print head assembly is comprised of a print head 13 and a heatsink 15. Referring to FIG. 2, the print head 13 of print head assembly 12 includes a plurality of heating elements 32, such as electrical resistors. When one of a plurality of switches 34 is closed, the associated heating element 32 is connected to a voltage potential source $V_S$.

Dye donor web 26, shown in FIG. 3, comprises a leader portion 27 followed by a repeating series of dye frames. The dye frames may be contiguous or spaced by interframe regions 29, as shown in FIG. 3. Each series includes in sequence yellow, magenta, and cyan dye frames. A single series is used to print one color plane on dye receiver medium 28. Dye donor web 26 may also be black for printing text, and for other applications.

Two LEDs 36 and 38 illuminate the dye donor web from above. LED 36 emits yellow light and LED 38 emits red light. Two photodetectors "A" and "B" are disposed below the dye donor web and receive light which passes through the dye donor web. Photodetectors "A" and "B" provide signals for identifying the start of each series, and each individual color dye frame in such series. For a more complete discussion of this identification system, reference is made to commonly assigned Reissue U.S. Pat. No. Re. 33,260 to S. Stephenson.

A problem with thermal head printers, is that the print head must be cooled. In particular, the print head must be cooled in a uniform manner to achieve uniformity of image intensity. Prior art devices incorporated cooling fins, ducts and fans, see for example U.S. Pat. No. 5,374,944, assigned to the same assignee as the present invention. Some of these prior art devices are either, uneconomical because they require a separate fan to blow air over a heatsink attached to the thermal head, or inefficient because air circulated through the entire machine is also used for cooling the print head. When using air circulated through entire machine to cool the print head, the air must be circulated at a higher volume than would be necessary if the air were blowing directly on the print head heatsink.

SUMMARY OF THE INVENTION

It is an object of the present invention to provide a more efficient means of cooling the print head of a thermal printer.

According to a feature of the present invention, a thermal printer dye donor cartridge has air ducts to channel the flow of air through the cartridge to a thermal print head for cooling of the print head. According to features of preferred embodiments of the present invention, air is directed into the cylindrical core of a spool of the dye donor cartridge and directed out of the spool, through cartridge vents in the cartridge enclosure, to cool the heatsink of a thermal print head.

The invention, and its objects and advantages, will become more apparent in the detailed description of the preferred embodiments presented below.

BRIEF DESCRIPTION OF THE DRAWINGS

FIG. 6 is a perspective view, partially in phantom, of a dye donor cartridge according to the present invention.

FIG. 7 is a perspective view of the spool of the cartridge shown in FIG. 6.

DETAILED DESCRIPTION OF THE INVENTION

The present description will be directed in particular to elements forming part of, or cooperating more directly with a thermal printer in accordance with the present invention. It is to be understood that elements not specifically shown or described may take various forms well known to those skilled in the art. While the description illustrates the present invention as it would be used in a thermal printer, it will be understood that aspects of the invention are applicable to cartridge systems other than printers.

Figure 1:
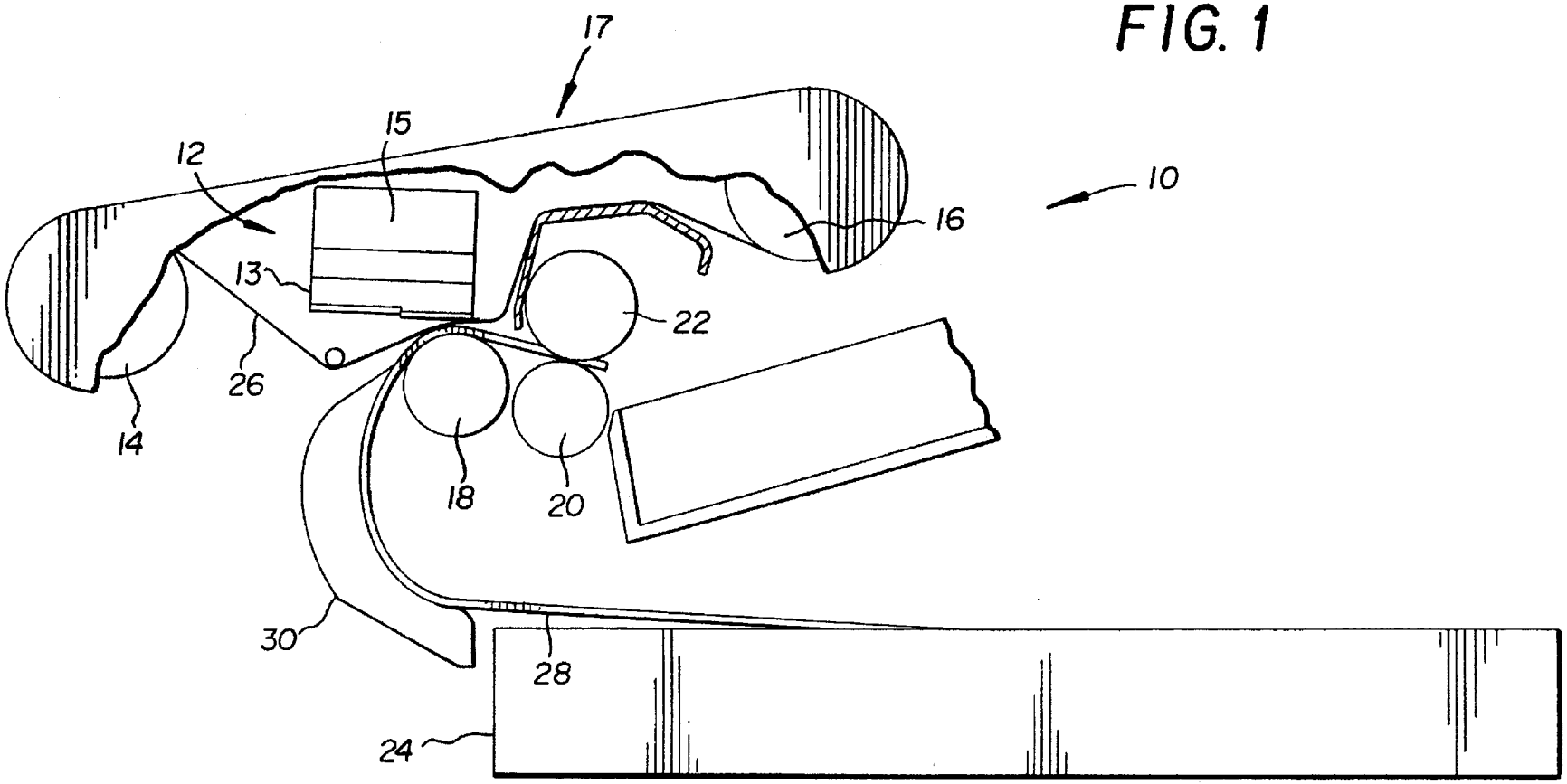
FIG. 1 is a schematic of a thermal printer employed to make color images on a dye receiver medium in accordance with this invention.
Figure 2:
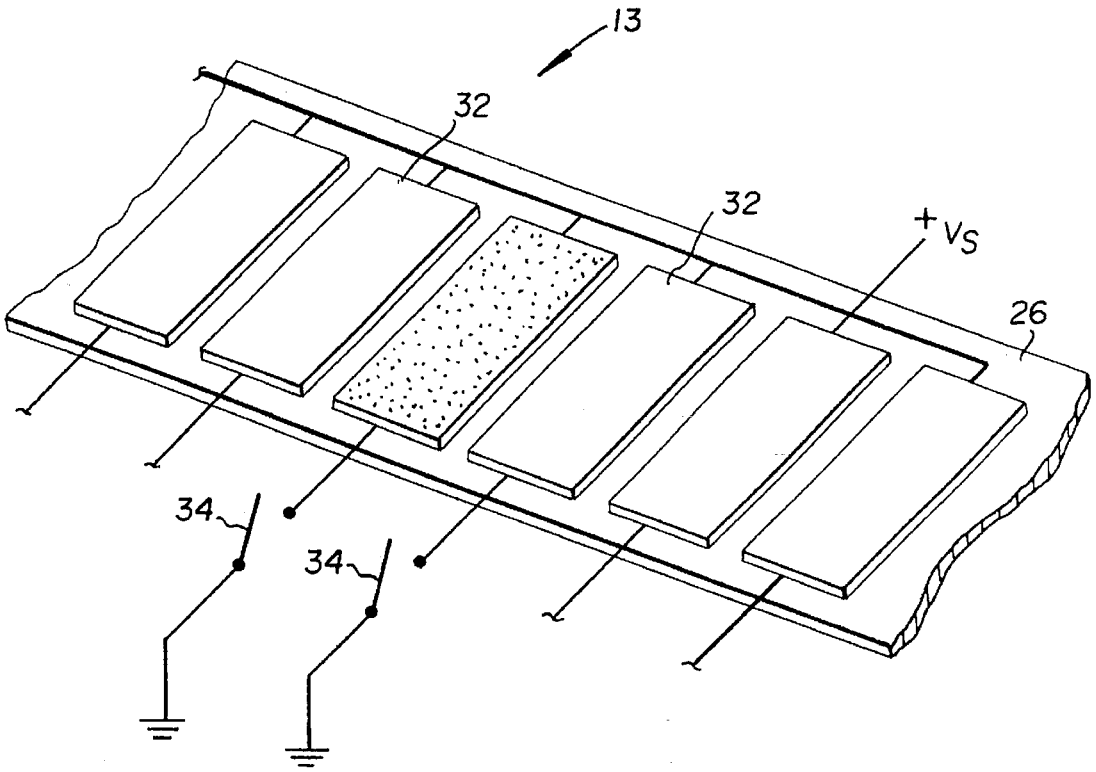
FIG. 2 is a schematic perspective of several heating elements used in the print head of the printer of FIG. 1.
Figure 3:
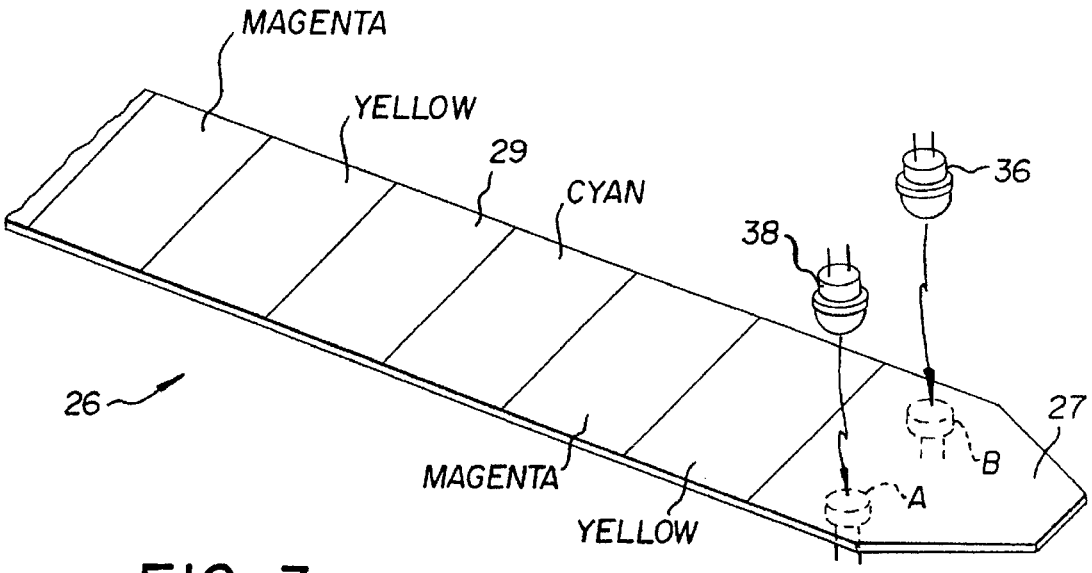
FIG. 3 is a strip of dye donor medium used in the thermal printer of FIG. 1.
Figure 4:
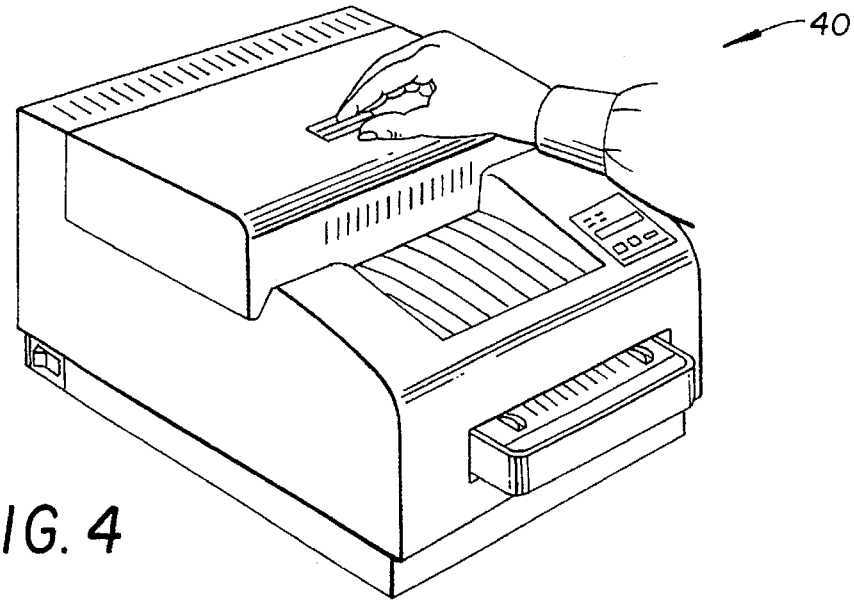
FIG. 4 is a perspective view of typical thermal printer.
Figure 5:
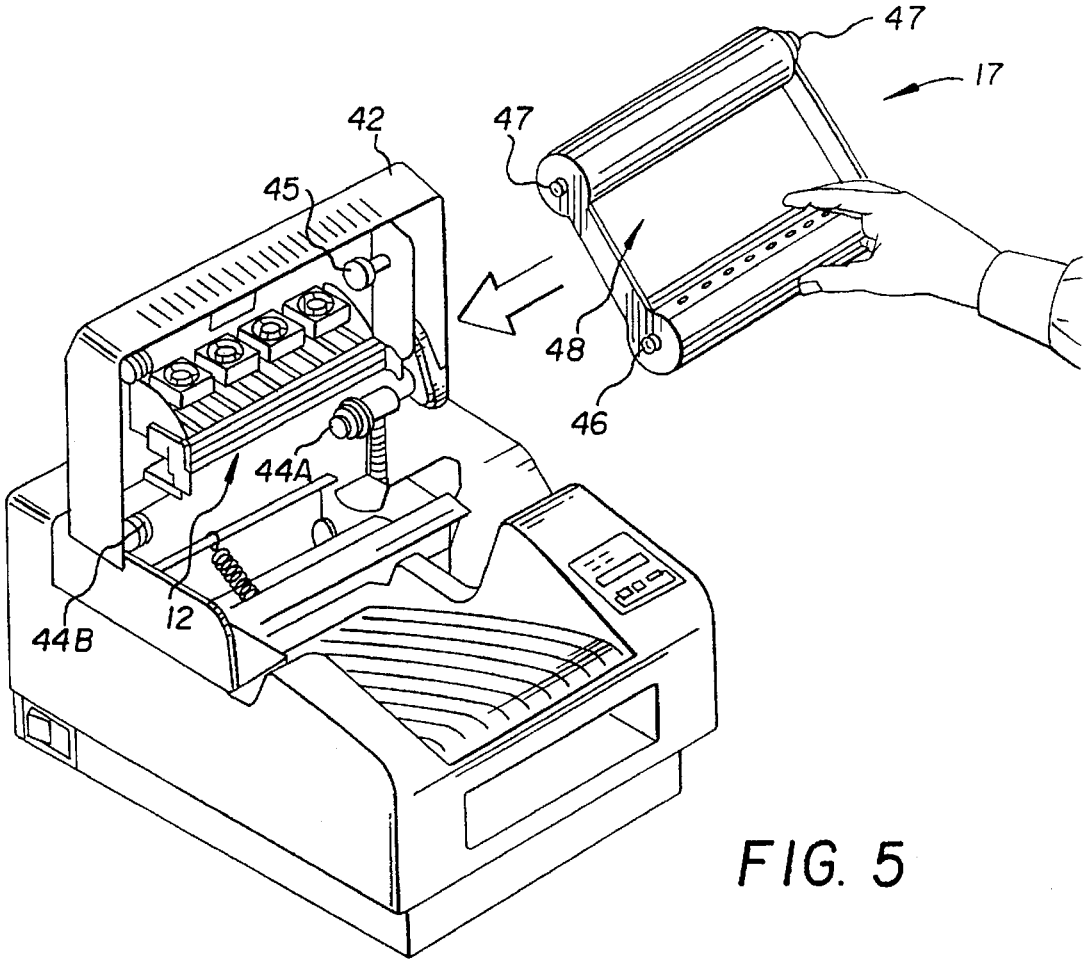
FIG. 5 is a perspective view of a thermal printer with the cover raised in preparation for insertion of a dye donor cartridge.

Referring now to the drawings, and in particular FIG. 4, a thermal printer is shown, referred to in general by numeral 40. FIG. 5 shows a dye donor cartridge 17 being installed in printer 40 after the cover 42 is raised. Print head 12 fits in the open central portion 48 of dye donor cartridge 17 after it is installed in printer 40. Hubs 44A, 44B and 45, mate with spool ends 46 and 47, of dye donor cartridge 17. Air is supplied to cartridge 17 through hub 44A or duct through spool end 46. A fan or other means is used to force air through hub 44A.

FIG. 6 shows a dye donor cartridge 17 according to the present invention. Supply roll 14 and take-up roll 16 are wound on spools 50, rotatably mounted in cartridge 17. Air for cooling print head assembly 12 is admitted through spool ends 46 and exits the hollow spool 50 through slots 52, shown in more detail in FIG. 7. After leaving slots 52, air exits cartridge 17 through cartridge vents 54 shown in FIG. 6, and is directed to print head heatsink 15. Although slots are shown in supply roll 14, exit opening could take the form of holes or other shapes. Air can also be supplied to cartridge 17 through hub 44B.

Figure 8:
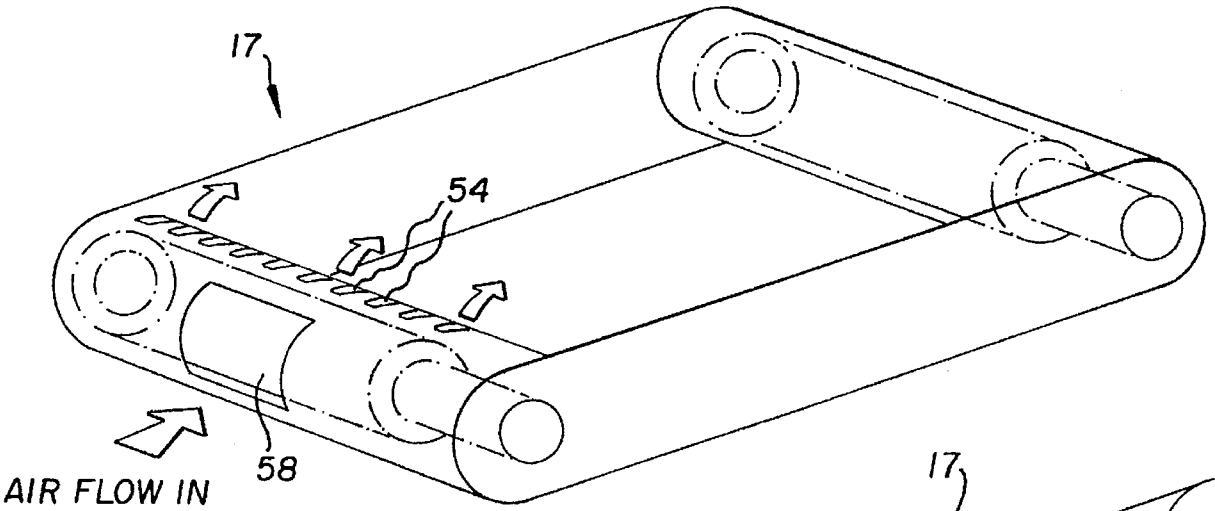
FIG. 8 is an alternate embodiment of a dye donor cartridge according to the present invention.

FIG. 8 shows an alternate embodiment of the present invention in which air flow is directed to an opening 58, in cartridge 17. Air flow exits cartridge 17 through vents 54 and is directed to print head heatsink 15 as described above.

Figure 9:
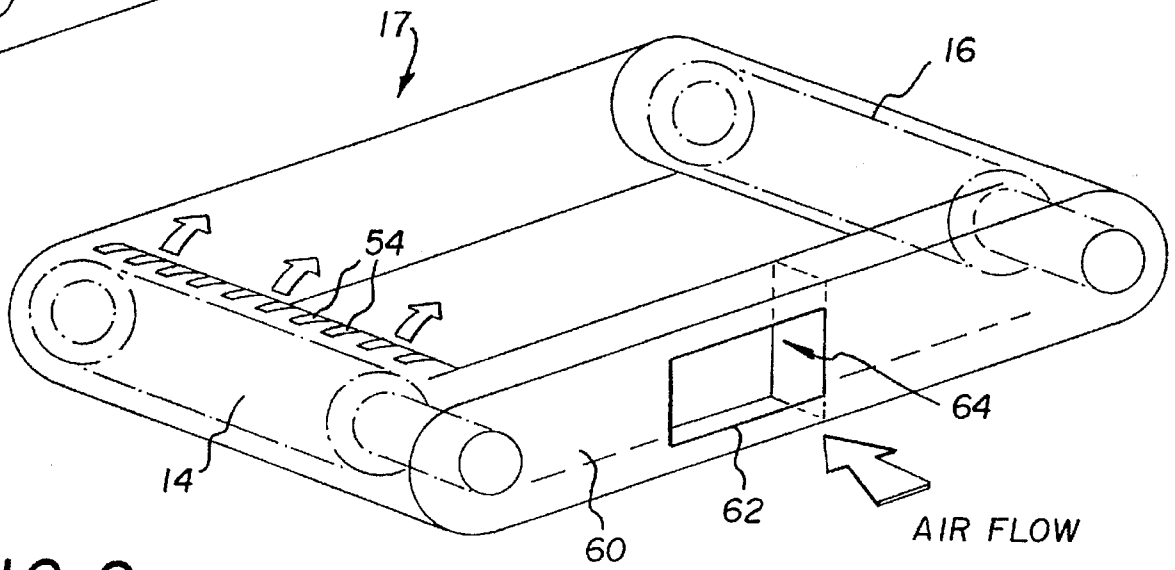
FIG. 9 is yet another embodiment of a dye donor cartridge according to the present invention.

FIG. 9 shows yet another embodiment of the invention in which cooling air enters sidewall 60 through orifice 62. Sidewall 60 is hollow to accommodate air flow from orifice 62 to supply roll 14. Baffle 64 blocks the flow of air to take-up roll 16. Air exit vents 54 as described above.

Figure 10:
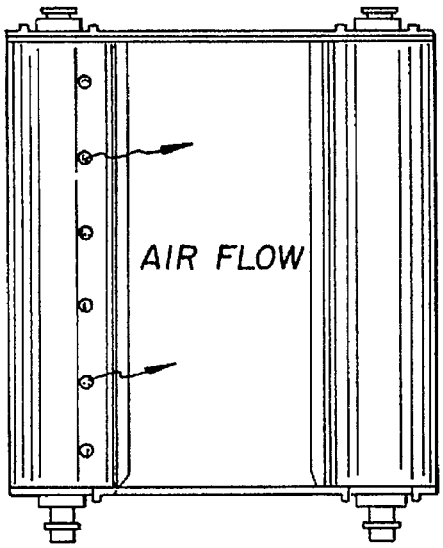
FIG. 10 is a plan view of a dye donor cartridge according to the present invention, showing an arrangement of cartridge vents.
Figure 11:
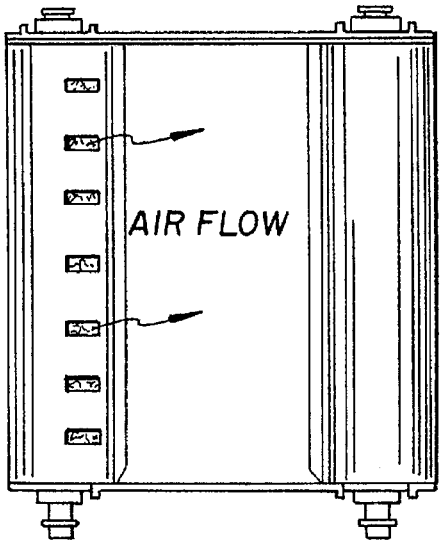
FIG. 11 is a planned view of an alternate embodiment of the dye donor cartridge for the present invention, showing an arrangement of the cartridge vents.
Figure 12:
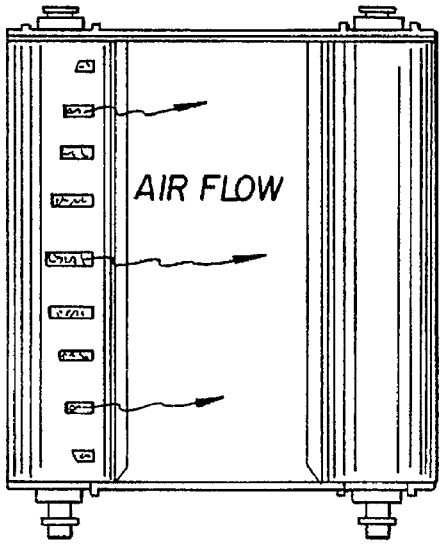
FIG. 12 is a planned view of yet another embodiment of a dye donor cartridge according to the present invention showing an arrangement of cartridge vents.

FIGS. 10, 11 and 12, show various arrangements for cartridge vents openings. In FIG. 10 cartridge vents 54 take the form of small holes for normal cooling. These vent openings may be used for such applications as desk top printers and other applications where less cooling is required. In FIG. 11 vents 54 are in the form of large slots for maximum cooling. These may be used for applications in the medical field where black, high density prints are required. Other uses may be in situations where the printer operates in an enclosed cabinet or kiosk, where extra cooling is required. FIG. 12 shows vents 54 with a variety of sizes. This embodiment is used when differential cooling across the page is needed to compensate for uniformity requirements. For example, some applications have high density borders printed on the dye receiver sheet, and more cooling would be required at the edges. In the embodiment shown in FIG. 12, the openings are larger at the center which in this case provides more cooling to the central part of the print head assembly heatsink.

Although the embodiments shown have used cooling from the supply roll to the print head assembly heatsink, cooling air could also be supplied to the take-up roll and directed at the heatsink. While cooling air would not normally be supplied to both the supply roll and take-up roll simultaneously, since the air flow from two opposite directions would cancel each other, it would be possible to design the cooling fins on the heatsink such that air could be directed from both the supply roll and the take-up roll and directed toward by the heatsink, with a heatsink baffle for redirecting the air upward. This embodiment may be used for applications where substantial cooling is required.

The invention has been described in detail with particular reference to preferred embodiment thereof, but it will be understood that variations and modifications can be effected within the spirit and scope of the invention as set forth in the claims.

PARTS LIST

| | | | |
|---|---|---|---|
| 1. | | 41. | |
| 2. | | 42. | cover |
| 3. | | 43. | |
| 4. | | 44A. | Hubs |
| 5. | | 44B. | Hubs |
| 6. | | 45. | Hubs |
| 7. | | 46. | Spool ends |
| 8. | | 47. | Spool ends |
| 9. | | 48. | Open central portion |
| 10. | Thermal printer | 49. | |
| 11. | | 50. | |
| 12. | Print Head assembly | 51. | |
| 13. | Print head | 52. | Spool slots |
| 14. | Supply roll | 53. | |
| 15. | Print head heatsink | 54. | Cartridge vents |
| 16. | Take-up roll | 55. | |
| 17. | Cartridge | 56. | |
| 18. | Roller platen assembly | 57. | |
| 19. | | 58. | Opening |
| 20. | Roller | 59. | |
| 21. | | 60. | Sidewall |
| 22. | Roller | 61. | |
| 23. | | 62. | Orifice |
| 24. | Supply | 63. | |
| 25. | | 64. | Baffle |
| 26. | Donor web | 65. | |
| 27. | Leader | 66. | |
| 28. | Sheet | 67. | |
| 29. | Interframe region | 68. | |
| 30. | Transport guide | 69. | |
| 31. | | 70. | |
| 32. | Heating elements | 71. | |
| 33. | | 72. | |
| 34. | Switches | 73. | |
| 35. | | 74. | |
| 36. | LED | 75. | |
| 37. | | 76. | |
| 38. | LED | 77. | |
| 39. | | 78. | |
| 40. | Printer | 79. | |
| | | 80. | |

What is claimed is:

1. A dye donor cartridge for a thermal printer for maintaining a print head at a uniform temperature, said cartridge comprising:

a supply roll for dispensing a dye donor web;

a take-up roll for receiving said dye donor web;

an enclosure partially surrounding at least said supply roll; vents in said enclosure; and an opening in said enclosure, said opening and vents cooling the print head by allowing air to be directed to the print head.

2. The dye donor cartridge of claim 1 wherein said supply roll is mounted on a spool wherein air entering said opening travels through a hollow interior of said spool and exits said spool through a slot in said spool.

3. The dye donor cartridge of claim 1 wherein said take-up roll is mounted on a spool wherein air entering said opening travels through a hollow interior of said spool and exits said spool through a slot in said spool.

4. The dye donor cartridge of claim 1 wherein the vents are uniform in size.

5. The dye donor cartridge of claim 1 wherein the vents are various sizes, with larger vent openings located adjacent to areas of the print head requiring extra cooling.

6. The dye donor cartridge of claim 1 wherein said opening is in a side wall of said dye donor cartridge.

7. The dye donor cartridge of claim 1 wherein said opening is in a portion of the enclosure surrounding a supply roll of said cartridge.

8. The dye donor cartridge of claim 1 wherein said opening is in a portion of the enclosure surrounding the take-up roll of said cartridge.

9. A dye donor cartridge for a thermal printer for maintaining a print head at a uniform temperature, said dye donor cartridge comprising;

a supply roll having a dye donor web;

a take-up roll for receiving the dye donor web from said supply roll;

an enclosure at least partially surrounding said supply roll;

an second enclosure at least partially surrounding said take-up roll;

side walls connecting said supply roll enclosure and said take-up roll enclosure;

an opening in said cartridge for receiving cooling air; and vents in the cartridge, said vents cooling said print head by directing air flow through the opening to the vents.

* * * * *